US007546652B1

(12) United States Patent
Maloof et al.

(10) Patent No.: US 7,546,652 B1
(45) Date of Patent: Jun. 16, 2009

(54) COLIC SWING

(76) Inventors: Michelle Maloof, 51 Matthews St., Dedham, MA (US) 02026; Mark C. Griffin, 176 Colwell Dr., Dedham, MA (US) 02026

( * ) Notice: Subject to any disclaimer, the term of this patent is extended or adjusted under 35 U.S.C. 154(b) by 0 days.

(21) Appl. No.: 12/011,140

(22) Filed: Jan. 23, 2008

(51) Int. Cl.
*A63G 9/00* (2006.01)
*A47D 13/10* (2006.01)

(52) U.S. Cl. ..... 5/655; 5/101; 5/638; 5/725; 5/733; 5/734; 5/915; 5/120; 5/922; 472/118; 128/845

(58) Field of Classification Search ..... 5/655, 5/603, 612, 638, 632, 646, 648, 101, 120, 5/108, 725, 734, 731, 733, 915, 922; 472/118, 472/125; 128/845, 869
See application file for complete search history.

(56) References Cited

U.S. PATENT DOCUMENTS

| | | | | |
|---|---|---|---|---|
| 49,465 | A | 8/1865 | Wolfinger | |
| 79,147 | A | 6/1868 | Rymal | |
| 461,541 | A | 10/1891 | Bunker | |
| 860,156 | A | 7/1907 | Scalf | |
| 1,505,117 | A | 8/1924 | Withun | |
| 2,672,181 | A * | 3/1954 | Rose | 297/119 |
| 2,959,794 | A * | 11/1960 | Souleles | 5/725 |
| 2,979,734 | A | 4/1961 | Saint et al. | |
| 2,990,558 | A * | 7/1961 | Engel | 5/725 |
| 3,071,339 | A | 1/1963 | Saint | |
| 3,075,101 | A | 1/1963 | Neff | |
| 3,842,450 | A | 10/1974 | Pad | |
| 3,897,102 | A * | 7/1975 | Lemaire | 5/656 |
| 4,681,096 | A | 7/1987 | Cuervo | |
| 4,947,832 | A | 8/1990 | Blitzer | |
| 5,063,912 | A | 11/1991 | Hughes | |
| 5,127,422 | A * | 7/1992 | Colon | 5/655 |
| 5,233,714 | A | 8/1993 | De Bell Daniel | |
| 5,562,548 | A | 10/1996 | Pinch et al. | |
| 5,743,802 | A | 4/1998 | Shives | |
| 5,769,727 | A | 6/1998 | Fair et al. | |
| 5,803,817 | A | 9/1998 | Stern | |
| 5,860,698 | A | 1/1999 | Asenstorfer et al. | |
| 5,975,631 | A | 11/1999 | Fair et al. | |
| 6,027,409 | A | 2/2000 | Favorito et al. | |
| 6,070,585 | A * | 6/2000 | Fery et al. | 128/845 |
| 6,142,963 | A | 11/2000 | Black et al. | |
| 7,107,639 | B2 * | 9/2006 | Taricani | 5/655 |
| 7,203,981 | B1 | 4/2007 | Cowgill | |
| 2007/0022537 | A1 * | 2/2007 | Faustick | 5/655 |
| 2008/0029103 | A1 * | 2/2008 | Regev et al. | 128/875 |

* cited by examiner

*Primary Examiner*—Alexander Grosz
(74) *Attorney, Agent, or Firm*—John P. McGonagle

(57) ABSTRACT

A standard child swing apparatus with a holder for supporting a baby on its abdomen. A vibration unit is also included within the holder.

8 Claims, 4 Drawing Sheets

FIG. 1
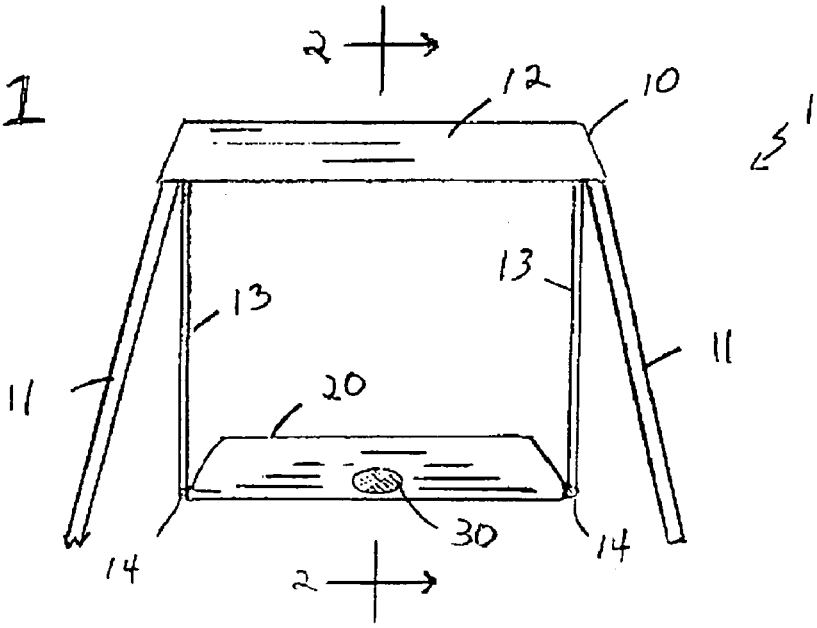
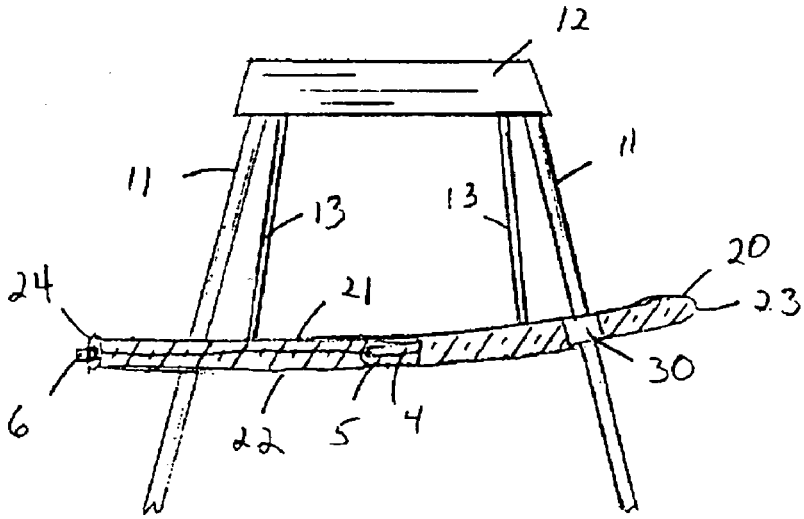
FIG. 2

COLIC SWING

BACKGROUND OF THE INVENTION

This invention relates to swings for children, and in particular, to a swing with a device for supporting small children on their abdomen.

Some babies are born with a condition known as colic which irritates them and makes them uncomfortable. When a baby experiences abdominal pains, it is recommended to hold it in a manner so as to apply gentle pressure to the abdomen for a period of time. It is also recommended to rock the baby gently at that time. Such special holding is uncomfortable for the care giver, especially as the baby grows in size. Uncomfortable holding and rocking may tire the care giver, who may thus be forced to abandon the effort before the baby experiences relief. If this happens, the discomfort of the baby continues, and the special holding and rocking was for nothing.

Historically, swings for very young children have included a support frame with side frame members supporting a horizontal housing from which a seat is hung. Early swings were mechanically driven through a wind-up/spring mechanism. More modern swings include motorized drive mechanisms which are electrically powered.

While many swings will comfort most babies and gently rock them to sleep, additional stimulation and special holding techniques are typically required to comfort and soothe babies with colic. It would be desirable to apply such techniques to swings.

SUMMARY OF THE INVENTION

The present invention answers the needs of special holding to apply pressure to the abdomen while also rocking the baby. The present invention provides a standard child swing apparatus with a holder for supporting the baby on its abdomen. A vibration unit is also included within the holder.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 1 is a front view, partly in section, of the present invention.

FIG. 2 is a sectional view along the line 2-2 of FIG. 1.

DETAILED DESCRIPTION OF THE INVENTION

Figure 3:
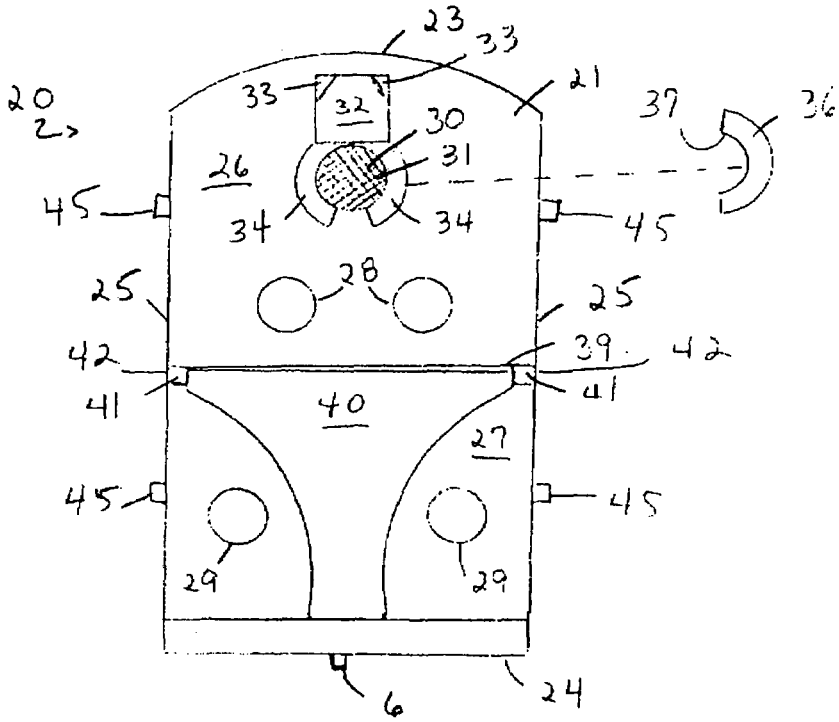
FIG. 3 is a top view of the holder of the present invention.
Figure 4:
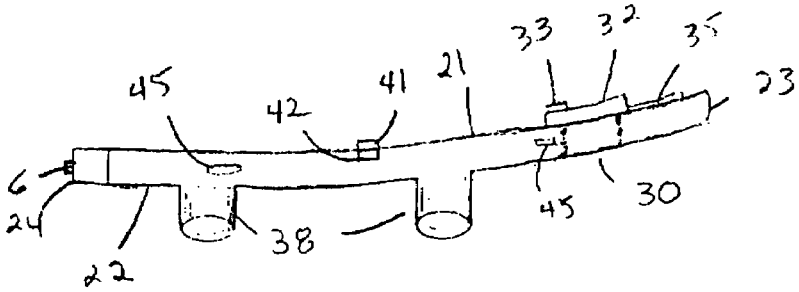
FIG. 4 is a side view of the holder of FIG. 3.
Figure 5:
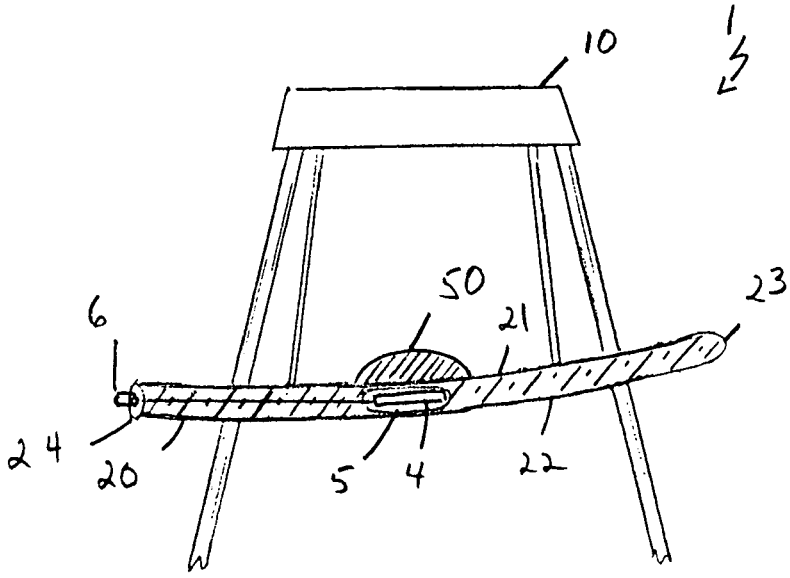
FIG. 5 is a cross sectional view of the swing with a cushion attached to said baby holder.
Figure 6:
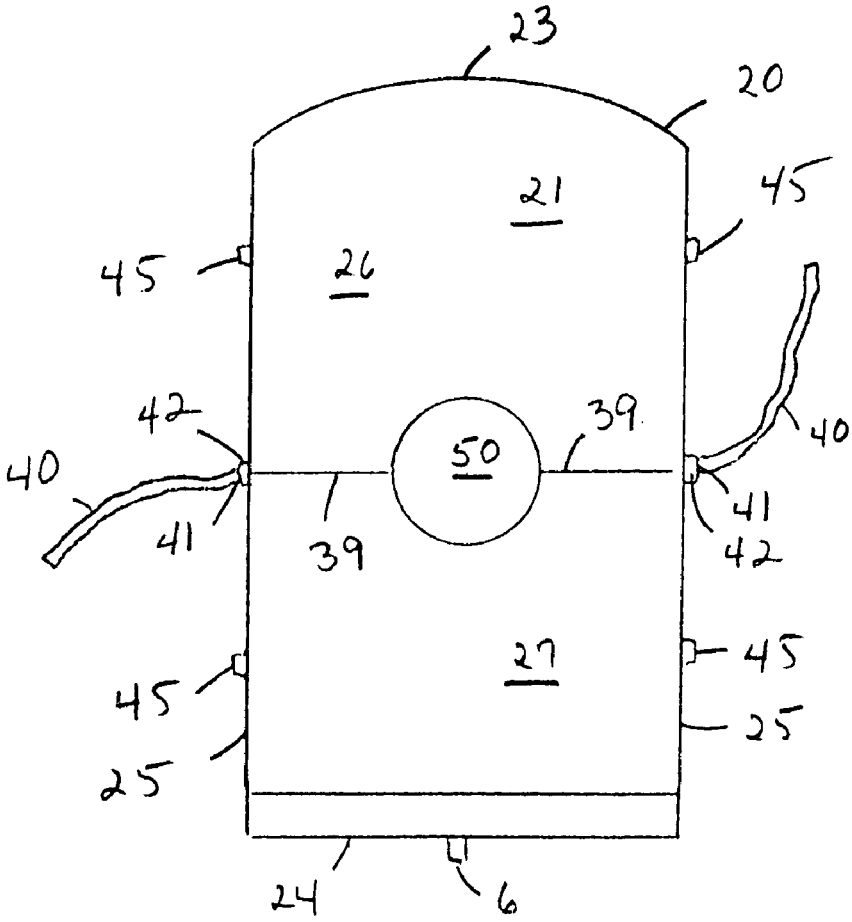
FIG. 6 is a top view of another embodiment of the holder.

Referring to the drawings in detail wherein like elements are indicated by like numerals, there is shown a colic swing 1 comprised of a swing 10 with a baby holder 20. The swing 10 has four, floor-contacting legs 11 supporting a horizontal housing 12 from which four supports 13 extend vertically downward, said supports 13 terminating in end means 14 adapted to releasably connect to the baby holder 20. The horizontal housing 12 may contain a wind-up/spring mechanism or electrically-powered, motorized drive mechanism adapted to provide a swinging motion to the supports 13. The horizontal housing 12 may also contain various controls for selecting from a plurality of amplitudes and/or speeds for the swing motion of the supports 13.

The baby holder 20 is a generally planar element with a top surface 21, a bottom surface 22, a front 23, a rear 24, and two sides 25. The baby holder front 23 and rear 24 define a baby holder longitudinal axis. The baby holder 20 lies generally in a horizontal plane while the swing 10 is at rest and has a gentle, longitudinal, upward, concave shape. The baby holder 20 is longitudinally divided into a forward portion 26 and a rearward portion 27. The baby holder 20 also has a battery operated vibrator 4 located in a cavity 5 in the baby holder rearward portion 27. The vibrator 4 has a control 6 protruding from the baby holder rear 24. The baby holder sides 25 have connector means 45 fixedly attached thereto, said connector means 45 adapted to be attached to said support end means 14.

The holder forward portion 26 has an optional forward air pocket 30 or breathing hole, and two optional parallel, arm holes 28. As seen in FIG. 2, the air pocket or breathing hole 30 extends through the baby holder 20, from the top surface 21 to the bottom surface 22. The forward air pocket 30 has a soft mesh 31 covering the pocket 30. Two hook and pile fastening strips 34 sold under the trademark VELCRO are attached to the holder top surface 21 on each side of the air pocket 30. A third VELCRO strip 35 is attached to the holder top surface 21 near to the holder front 23. A flap 32 with two surfaces is attached immediately forward of the air pocket 30. The flap 32 has a VELCRO fastener 33 on both surfaces and is adapted for attachment in a closed position over the air pocket 30 to the VELCRO strips 34 on each side of the air pocket 30 and in an open position to the forward VELCRO strip 35. A donut shaped head rest 36 with a VELCRO strip 37 attached thereto is adapted for attachment to one of the VELCRO strips 34 on each side of the breathing hole 30.

The holder rearward portion 27 has two optional parallel leg holes 29 formed therein. The leg holes 29 and arm holes 28 are adapted to receive a baby's legs and arms while the baby is laying on the holder top surface 21. The leg holes 29 and arm holes 28 may optionally have cylindrical, cloth sleeves 38 attached thereto adapted to keep a baby's legs and arms warm while laying on the holder 20 with legs and arms protruding through the holes 29, 28. A safety strap 40 is attached to the holder top surface 21. The safety strap 40 has two side, forward ends terminating in fasteners 41 and adapted for attachment to two fasteners 42 attached to the holder sides 25 at a junction 39 of the forward portion 26 and rearward portion 27. The safety strap 40 may have a diaper shape in which a portion of the safety strap 40 is attached to the baby holder rear 24.

The baby holder top surface 21 may have a small cushion 50 attached thereto at the approximate junction 39 of the forward portion 26 and rearward portion 27.

In operation, a baby is placed on the baby holder top surface 21, face-down either flat on the top surface 21 or on top of the optional cushion 50. The safety strap 40 is fastened about the baby thereby holding the baby securely to the baby holder 20. The swing 10 may then be activated providing a swinging motion to the baby holder 20. The vibrator 4 may also be activated providing a gentle vibration to the baby's abdominal area.

It is understood that the above-described embodiment is merely illustrative of the application. Other embodiments may be readily devised by those skilled in the art which will embody the principles of the invention and fall within the spirit and scope thereof.

We claim:

1. A colic swing, comprising:

a baby holder comprised of a generally planar element with a top surface, a bottom surface, a front, a rear, and two sides, said baby holder front and rear defining a baby holder longitudinal axis, said baby holder being longitudinally divided into a forward portion and a rearward portion;

a swing having four, floor-contacting legs supporting a horizontal housing from which four supports extend vertically downward, said supports terminating in end means adapted to releasably connect to the baby holder, said housing having means for providing a swinging motion to the supports;

a safety strap attached to the holder top surface, said safety strap having two sides, forward ends terminating in strap fasteners and adapted for attachment to two baby holder fasteners attached to the baby holder sides at a junction of the baby holder forward and rearward portions;

a forward air pocket in the baby holder forward portion, extending from the baby holder top surface to the baby holder bottom surface, said forward air pocket having a mesh covering the forward air pocket on the baby holder top surface; and two parallel arm holes in said baby holder forward portion, extending from the baby holder top surface to the baby holder bottom surface;

two parallel leg holders in said baby holder rearward portion, extending from the baby holder top surface to the baby holder bottom surface;

said arm holes and leg holes being adapted to receive a baby's arms and legs while the baby is laying on the holder top surface;

wherein said arm and leg holders have cylindrical cloth sleeves attached thereto.

2. A colic swing as recited in claim 1, further comprising:

connector means fixedly attached to said baby holder sides, said connector means adapted to be attached to said swing support end means.

3. A colic swing as recited in claim 1, further comprising:

a flap centrally attached to said baby holder top surface forward portion adjacent the baby holder top surface front, said flap having one end attached adjacent the said air pocket and is adapted for releasable attachment in a closed position over the air pocket.

4. A colic swing as recited in claim 3, further comprising:

a donut shaped head rest adapted for releasable attachment on each side of the air pocket.

5. A colic swing as recited in claim 4, wherein:

the safety strap has a diaper shape in which a portion of the safety strap is attached to the baby holder rear.

6. A colic swing as recited in claim 1, further comprising:

a cushion attached to the baby holder top surface at the approximate junction of the baby holder forward and rearward portions.

7. A colic swing as recited in claim 1, further comprising a vibrator located in a cavity in the rearward portion of the baby holder.

8. A colic swing as recited in claim 7, wherein:

said vibrator has a control protruding from the baby holder rear.

* * * * *